US005500182A

United States Patent [19]

Roach

[11] Patent Number: 5,500,182

[45] Date of Patent: Mar. 19, 1996

[54] CERAMIC COMPOSITE BODIES WITH INCREASED METAL CONTENT

[75] Inventor: Philip J. Roach, Newark, Del.

[73] Assignee: Lanxide Technology Company, LP, Newark, Del.

[21] Appl. No.: 960,408

[22] PCT Filed: Jul. 12, 1991

[86] PCT No.: PCT/US91/04949

§ 371 Date: Jan. 11, 1993

§ 102(e) Date: Jan. 11, 1993

[51] Int. Cl.[6] ..... B22F 9/12

[52] U.S. Cl. ..... 419/45; 419/48; 419/49; 419/53; 419/55; 419/14

[58] Field of Search ..... 419/45, 48, 49, 419/53, 55, 14

[56] References Cited

U.S. PATENT DOCUMENTS

| | | | |
|---|---|---|---|
| 2,938,807 | 5/1960 | Anderson | 264/63 |
| 3,758,662 | 9/1973 | Tobin et al. | 264/332 |
| 3,864,154 | 2/1975 | Gazza et al. | 29/123 B |
| 3,937,619 | 2/1976 | Clougherty | 75/238 |
| 3,953,177 | 4/1976 | Sedlatschek et al. | 29/182.2 |
| 4,353,714 | 10/1982 | Lee et al. | 51/295 |
| 4,471,059 | 9/1984 | Yoshino et al. | 501/96 |
| 4,492,670 | 1/1985 | Mizrah et al. | 419/9 |
| 4,512,946 | 4/1985 | Brun | 264/332 |
| 4,544,524 | 10/1985 | Mizrah et al. | 419/9 |
| 4,585,618 | 4/1986 | Fresnel et al. | 419/12 |
| 4,595,545 | 6/1986 | Sane | 264/65 |
| 4,605,440 | 8/1986 | Halverson et al. | 75/238 |
| 4,617,053 | 10/1986 | Joó et al. | 75/244 |
| 4,692,418 | 9/1987 | Boecker et al. | 501/90 |
| 4,702,770 | 10/1987 | Pyzik et al. | 75/236 |
| 4,713,360 | 12/1987 | Newkirk et al. | 501/87 |
| 4,718,941 | 1/1988 | Halverson et al. | 75/236 |
| 4,777,014 | 10/1988 | Newkirk et al. | 419/12 |
| 4,793,968 | 12/1988 | Mosser et al. | 428/550 |
| 4,834,938 | 5/1989 | Pyzik et al. | 419/6 |
| 4,868,143 | 9/1989 | Newkirk et al. | 501/127 |
| 4,885,130 | 12/1989 | Claar et al. | 419/12 |
| 4,885,131 | 12/1989 | Newkirk | 419/12 |
| 4,891,338 | 1/1990 | Gesing et al. | 501/87 |
| 4,904,446 | 2/1990 | White et al. | 419/13 |
| 4,915,736 | 4/1990 | Claar et al. | 75/238 |
| 4,940,679 | 7/1990 | Claar et al. | 501/96 |
| 4,978,644 | 12/1990 | White et al. | 501/96 |
| 5,000,248 | 3/1991 | Newkirk et al. | 164/97 |

(List continued on next page.)

FOREIGN PATENT DOCUMENTS

| | | |
|---|---|---|
| 0113249 | 7/1984 | European Pat. Off. . |
| 0165707 | 12/1985 | European Pat. Off. . |
| 0193292 | 9/1986 | European Pat. Off. . |
| 0239520 | 9/1987 | European Pat. Off. . |
| 0250210 | 12/1987 | European Pat. Off. . |
| 0322341 | 6/1989 | European Pat. Off. . |
| 1492477 | 11/1977 | United Kingdom . |

OTHER PUBLICATIONS

International Search Report for International Patent Application Ser. No. PCT/US91/04949.

*Primary Examiner*—Donald P. Walsh
*Assistant Examiner*—Daniel Jenkins
*Attorney, Agent, or Firm*—Jeffrey R. Ramberg

[57] ABSTRACT

This invention relates generally to a novel method for forming a self-supporting body. Specifically, the formed self-supporting body has a higher volume percent of metallic constituent relative to a body formed by similar techniques. A first porous self-supporting body is formed by reactively infiltrating a molten parent metal into a bed or mass containing a boron donor material and a carbon donor material (e.g., boron carbide) and/or a boron donor material and a nitrogen material (e.g., boron nitride) and, optionally, one or more inert fillers. Additionally, powdered parent metal may be admixed with a mass to be reactively infiltrated to form additional porosity therein. The porous self-supporting body which is formed by the reactive infiltration process according to this invention should contain at least some interconnected porosity which is capable of being filled in a subsequent step with additional metal, thus increasing the volume percent of parent metal in the body at the expense of porosity.

18 Claims, 1 Drawing Sheet

U.S. PATENT DOCUMENTS

| | | | |
|---|---|---|---|
| 5,004,714 | 4/1991 | Claar et al. | 501/134 |
| 5,010,044 | 4/1991 | Newkirk | 501/93 |
| 5,011,063 | 4/1991 | Claar | 228/122 |
| 5,017,334 | 5/1991 | Claar et al. | 419/12 |
| 5,019,539 | 5/1991 | Claar et al. | 501/87 |
| 5,024,794 | 6/1991 | Newkirk et al. | 264/57 |
| 5,066,622 | 11/1991 | Claar et al. | 501/87 |
| 5,126,102 | 6/1992 | Takahashi et al. | 419/2 |

CERAMIC COMPOSITE BODIES WITH INCREASED METAL CONTENT

TECHNICAL FIELD

This invention relates generally to a novel method for forming a self-supporting body. Specifically, the formed self-supporting body has a higher volume percent of metallic constituent relative to a body formed by similar techniques. A first porous self-supporting body is formed by reactively infiltrating a molten parent metal into a bed or mass containing a boron donor material and a carbon donor material (e.g., boron carbide) and/or a boron donor material and a nitrogen donor material (e.g., boron nitride) and, optionally, one or more inert fillers. Additionally, powdered parent metal may be admixed with a mass to be reactively infiltrated to form additional porosity therein. The first porous self-supporting body which is formed by the reactive infiltration process according to this invention should contain at least some interconnected porosity which is capable of being filled in a subsequent step with additional metal, thus increasing the volume percent of parent metal in the body at the expense of porosity.

BACKGROUND ART

In recent years, there has been an increasing interest in the use of ceramics for structural applications historically served by metals. The impetus for this interest has been the superiority of ceramics with respect to certain properties, such as corrosion resistance, hardness, wear resistance, modulus of elasticity, and refractory capabilities when compared with metals.

However, a major limitation on the use of ceramics for such purposes is the feasibility and cost of producing the desired ceramic structures. For example, the production of ceramic boride bodies by the methods of hot pressing, reaction sintering and reaction hot pressing is well known. In the case of hot pressing, fine powder particles of the desired boride are compacted at high temperatures and pressures. Reaction hot pressing involves, for example, compacting at elevated temperatures and pressures boron or a metal boride with a suitable metal-containing powder. U.S. Pat. No. 3,937,619 to Clougherty describes the preparation of a boride body by hot pressing a mixture of powdered metal with a powdered diboride, and U.S. Pat. No. 4,512,946 to Brun describes hot pressing ceramic powder with boron and a metal hydride to form a boride composite.

However, these hot pressing methods require special handling and expensive special equipment, they are limited as to the size and shape of the ceramic part produced, and they typically involve low process productivities and high manufacturing cost.

A second major limitation on the use of ceramics for structural applications is their general lack of toughness (i.e. damage tolerance or resistance to fracture). This characteristic tends to result in sudden, easily induced, catastrophic failure of ceramics in applications involving even rather moderate tensile stresses. This lack of toughness tends to be particularly common in monolithic ceramic boride bodies.

One approach to overcome this problem has been to attempt to use ceramics in combination with metals, for example, as cermets or metal matrix composites. The objective of this approach is to obtain a combination of the best properties of the ceramic (e.g. hardness and/or stiffness) and the metal (e.g. ductility). U.S. Pat. No. 4,585,618 to Fresnel, et al., discloses a method of producing a cermet whereby a bulk reaction mixture of particulate reactants, which react to produce a sintered self-sustaining ceramic body, is reacted while in contact with a molten metal. The molten metal infiltrates at least a portion of the resulting ceramic body. Exemplary of such a reaction mixture is one containing titanium, aluminum and boron oxide (all in particulate form), which is heated while in contact with a pool of molten aluminum. The reaction mixture reacts to form titanium diboride and alumina as the ceramic phase, which is infiltrated by the molten aluminum. Thus, this method uses the aluminum in the reaction mixture principally as a reducing agent. Further, the external pool of molten aluminum is not being used as a source of precursor metal for a boride forming reaction, but rather it is being utilized as a means to fill the pores in the resulting ceramic structure. This creates cermets which are wettable and resistant to molten aluminum. These cermets are particularly useful in aluminum production cells as components which contact the molten aluminum produced but preferably remain out of contact with the molten cryolite.

European Application 0,113,249 to Reeve, et al. discloses a method for making a cermet by first forming in situ dispersed particles of a ceramic phase in a molten metal phase, and then maintaining this molten condition for a time sufficient to effect formation of an intergrown ceramic network. Formation of the ceramic phase is illustrated by reacting a titanium salt with a boron salt in a molten metal such as aluminum. A ceramic boride is developed in situ and becomes an intergrown network. There is, however, no infiltration, and further the boride is formed as a precipitate in the molten metal. Both examples in the application expressly state that no grains were formed of $TiAl_3$, $AlB_2$, or $AlB_{12}$, but rather $TiB_2$ is formed demonstrating the fact that the aluminum is not the metal precursor to the boride.

U.S. Pat. No. 3,864,154 to Gazza, et al. discloses a ceramicmetal system produced by infiltration. An $AlB_{12}$ compact was impregnated with molten aluminum under vacuum to yield a system of these components. Other materials prepared included $SiB_6$—Al, B—Al; $B_4C$—Al/Si; and $AlB_{12}$—B—Al. There is no suggestion whatsoever of a reaction, and no suggestion of making composites involving a reaction with the infiltrating metal nor of any reaction product embedding an inert filler or being part of a composite.

U.S. Pat. No. 4,605,440 to Halverson, et al., discloses that in order to obtain $B_4C$—Al composites, a $B_4C$—Al compact (formed by cold pressing a homogeneous mixture of $B_4C$ and Al powders) is subjected to sintering in either a vacuum or an argon atmosphere. There is no infiltration of molten metal from a pool or body of molten precursor metal into a preform. Further, there is no mention of a reaction product embedding an inert filler in order to obtain composites utilizing the favorable properties of the filler.

While these concepts for producing cermet materials have in some cases produced promising results, there is a general need for more effective and economical methods to prepare boride-containing materials.

DESCRIPTION OF COMMONLY OWNED U.S. PATENTS AND PATENT APPLICATIONS

Many of the above-discussed problems associated with the production of boride-containing materials have been addressed in U.S. Pat. No. 4,885,130 (hereinafter "Patent '130"), which issued on Dec. 5, 1989, in the names of T. Dennis Claar, Steven M. Mason, Kevin P. Pochopien, Danny R. White, and William B. Johnson, and is entitled "Process for Preparing Self-Supporting Bodies and Products Produced Thereby".

Briefly summarizing the disclosure of Patent '130, self-supporting ceramic bodies are produced by utilizing a parent metal infiltration and reaction process (i.e., reactive infiltration) in the presence of a mass comprising boron carbide. Particularly, a bed or mass comprising boron carbide and, optionally, one or more of a boron donor material and a carbon donor material, is infiltrated by molten parent metal, and the bed may be comprised entirely of boron carbide or only partially of boron carbide, thus resulting in a self-supporting body comprising, at least in part, one or more parent metal boron-containing compounds, which compounds include a parent metal boride or a parent metal boro carbide, or both, and typically also may include a parent metal carbide. It is also disclosed that the mass comprising boron carbide which is to be infiltrated may also contain one or more inert fillers mixed with the boron carbide. Accordingly, by combining an inert filler, the result will be a composite body having a matrix produced by the reactive infiltration of the parent metal, said matrix comprising at least one boron-containing compound, and the matrix may also include a parent metal carbide, the matrix embedding the inert filler. It is further noted that the final composite body product in either of the above-discussed embodiments (i.e., filler or no filler) may include a residual metal as at least one metallic constituent of the original parent metal.

Broadly, in the disclosed method of Patent '130, a mass comprising boron carbide and, optionally, one or more of a boron donor material and a carbon donor material, is placed adjacent to or in contact with a body of molten metal or metal alloy, which is melted in a substantially inert environment within a particular temperature envelope. The molten metal infiltrates the mass comprising boron carbide and reacts with at least the boron carbide to form at least one reaction product. The boron carbide (and/or the boron donor material and/or the carbon donor material) is reducible, at least in part, by the molten parent metal, thereby forming the parent metal boron-containing compound (e.g., a parent metal boride and/or boro compound under the temperature conditions of the process). Typically, a parent metal carbide is also produced, and in certain cases, a parent metal boro carbide is produced. At least a portion of the reaction product is maintained in contact with the metal, and molten metal is drawn or transported toward the unreacted mass comprising boron carbide by a wicking or a capillary action. This transported metal forms additional parent metal boride, carbide, and/or boro carbide and the formation or development of a ceramic body is continued until either the parent metal or mass comprising boron carbide has been consumed, or until the reaction temperature is altered to be outside of the reaction temperature envelope. The resulting structure comprises one or more of a parent metal boride, a parent metal boro compound, a parent metal carbide, a metal (which, as discussed in Patent '130, is intended to include alloys and intermetallics), or voids, or any combination thereof. Moreover, these several phases may or may not be interconnected in one or more dimensions throughout the body. The final volume fractions of the boron-containing compounds (i.e., boride and boron compounds), carbon-containing compounds, and metallic phases, and the degree of interconnectivity, can be controlled by changing one or more conditions, such as the initial density of the mass comprising boron carbide, the relative amounts of boron carbide and parent metal, alloys of the parent metal, dilution of the boron carbide with a filler, the amount of boron donor material and/or carbon donor material mixed with the mass comprising boron carbide, temperature, and time. Preferably, conversion of the boron carbide to the parent metal boride, parent metal boro compound(s) and parent metal carbide is at least about 50%, and most preferably at least about 90%.

The typical environment or atmosphere which was utilized in Patent '130, was one which is relatively inert or unreactive under the process conditions. Particularly, it was disclosed that an argon gas, or a vacuum, for example, would be suitable process atmospheres. Still further, it was disclosed that when zirconium was used as the parent metal, the resulting composite comprised zirconium diboride, zirconium carbide, and residual zirconium metal. It was also disclosed that when aluminum parent metal was used with the process, the result was an aluminum boro carbide such as $Al_3B_{48}C_2$, $AlB_{12}C_2$ and/or $AlB_{24}C_4$, with aluminum parent metal and other unreacted unoxidized constituents of the parent metal remaining. Other parent metals which were disclosed as being suitable for use with the processing conditions included silicon, titanium, hafnium, lanthanum, iron, calcium, vanadium, niobium, magnesium, and beryllium.

Still further, it is disclosed that by adding a carbon donor material (e.g., graphite powder or carbon black) and/or a boron donor material (e.g., a boron powder, silicon borides, nickel borides and iron borides) to the mass comprising boron carbide, the ratio of parent metal-boride/parent metal-carbide can be adjusted. For example, if zirconium is used as the parent metal, the ratio of $ZrB_2/ZrC$ can be reduced if a carbon donor material is utilized (i.e., more ZrC is produced due to the addition of a carbon donor material in the mass of boron carbide) while if a boron donor material is utilized, the ratio of $ZrB_2/ZrC$ can be increased (i.e., more $ZrB_2$ is produced due to the addition of a boron donor material in the mass of boron carbide). Still further, the relative size of $ZrB_2$ platelets which are formed in the body may be larger than platelets that are formed by a similar process without the use of a boron donor material. Thus, the addition of a carbon donor material and/or a boron donor material may also affect the morphology of the resultant material.

In another related Patent, specifically, U.S. Pat. No. 4,915,736 (hereinafter referred to as "Patent '736"), issued in the names of Terry Dennis Claar and Gerhard Hans Schiroky, on Apr. 10, 1990, and entitled "A Method of Modifying Ceramic Composite Bodies By a Carburization Process and Articles Made Thereby", additional modification techniques are disclosed. Specifically, Patent '736 discloses that a ceramic composite body made in accordance with the teachings of, for example, Patent '130, can be modified by exposing the composite to a gaseous carburizing species. Such a gaseous carburizing species can be produced by, for example, embedding the composite body in a graphitic bedding and reacting at least a portion of the graphitic bedding with moisture or oxygen in a controlled atmosphere furnace. However, the furnace atmosphere should comprise typically, primarily, a non-reactive gas such as argon. It is not clear whether impurities present in the argon gas supply the necessary $O_2$ for forming a carburizing species, or whether the argon gas merely serves as a vehicle which contains impurities generated by some type of volatilization of components in the graphitic bedding or in the composite body. In addition, a gaseous carburizing species could be introduced directly into a controlled atmosphere furnace during heating of the composite body.

Once the gaseous carburizing species has been introduced into the controlled atmosphere furnace, the setup should be designed in such a manner to permit the carburizing species to be able to contact at least a portion of the surface of the composite body buried in the loosely packed graphitic powder. It is believed that carbon in the carburizing species, or carbon from the graphitic bedding, will dissolve into the interconnected zirconium carbide phase, which can then transport the dissolved carbon throughout substantially all of the composite body, if desired, by a vacancy diffusion process. Moreover, Patent '736 discloses that by controlling the time, the exposure of the composite body to the carburizing species and/or the temperature at which the carburization process occurs, a carburized zone or layer can be formed on the surface of the composite body. Such process could result in a hard, wear-resistant surface surrounding a core of composite material having a higher metal content and higher fracture toughness.

Thus, if a composite body was formed having a residual parent metal phase in the amount of between about 5–30 volume percent, such composite body could be modified by a post-carburization treatment to result in from about 0 to about 2 volume percent, typically about ½ to about 2 volume percent, of parent metal remaining in the composite body.

U.S. Pat. No. 4,885,131 (hereinafter "Patent '131"), issued in the name of Marc S. Newkirk on Dec. 5, 1989, and entitled "Process For Preparing Self-Supporting Bodies and Products Produced Thereby", discloses additional reactive infiltration formation techniques. Specifically, Patent '131 discloses that self-supporting bodies can be produced by a reactive infiltration of a parent metal into a mixture of a bed or mass comprising a boron donor material and a carbon donor material. The relative amounts of reactants and process conditions may be altered or controlled to yield a body containing varying volume percents of ceramic, metals, ratios of one ceramic or another and porosity.

In another related patent application, specifically, copending U.S. patent application Ser. No. 07/296,770 (which is equivalent to EPO Publication No. 0 383 715, published Aug. 22, 1991) (hereinafter referred to as "Application '770"), filed in the names of Terry Dennis Claar et al., on Jan. 13, 1989, and entitled "A Method of Producing Ceramic Composite Bodies", additional reactive infiltration formation techniques are disclosed. Specifically, Application '770 discloses various techniques for shaping a bed or mass comprising boron carbide into a predetermined shape and thereafter reactively infiltrating the bed or mass comprising boron carbide to form a self-supporting body of a desired size and shape.

U.S. Pat. No. 5,011,063 (hereinafter referred to as "Patent '063"), which issued on Apr. 30, 1991, from U.S. patent application Ser. No. 07/560,491, filed Jul. 23, 1990, which is a continuation of U.S. patent application Ser. No. 07/296,837 (which is equivalent to EPO Publication No. 0 378 501, which published Jul. 18, 1990), filed in the name of Terry Dennis Claar on Jan. 13, 1989, and entitled "A Method of Bonding A Ceramic Composite Body to a Second Body and Articles Produced Thereby", discloses various bonding techniques for bonding self-supporting bodies to second materials. Particularly, this patent discloses that a bed or mass comprising one or more boron-containing compounds is reactively infiltrated by a molten parent metal to produce a self-supporting body. Moreover, residual or excess metal is permitted to remain bonded to the formed self-supporting body. The excess metal is utilized to form a bond between the formed self-supporting body and another body (e.g., a metal body or a ceramic body of any particular size or shape).

The reactive infiltration of a parent metal into a bed or mass comprising boron nitride is disclosed in U.S. Pat. No. 4,904,446 (hereinafter "Patent '446"), issued in the names of Danny Ray White et al., on Feb. 27, 1990, and entitled "Process for Preparing Self-Supporting Bodies and Products Made Thereby". Specifically, this patent discloses that a bed or mass comprising boron nitride can be reactively infiltrated by a parent metal. A relative amount of reactants and process conditions may be altered or controlled to yield a body containing varying volume percents of ceramic, metal and/or porosity. Additionally, the self-supporting body which results comprises a boron-containing compound, a nitrogen-containing compound and, optionally, a metal. Additionally, inert fillers may be included in the formed self-supporting body.

A further post-treatment process for modifying the properties of produced ceramic composite bodies is disclosed in U.S. Pat. No. 5,004,714 (hereinafter "Patent '714"), which issued on Apr. 2, 1991, from U.S. patent application Ser. No. 07/296,966 (which is equivalent to EPO Publication No. 0 378 503, which published Jul. 18, 1990), filed in the names of Terry Dennis Claar et al., on Jan. 13, 1989, and entitled "A Method of Modifying Ceramic Composite Bodies By Post-Treatment Process and Articles Produced Thereby". Specifically, Patent '714 discloses that self-supporting bodies produced by a reactive infiltration technique can be post-treated by exposing the formed bodies to one or more metals and heating the exposed bodies to modify at least one property of the previously formed composite body. One specific example of a post-treatment modification step includes exposing a formed body to a siliconizing environment.

U.S. Pat. No. 5,019,539 (hereinafter "Patent '539"), which issued on May 28, 1991, from U.S. patent application Ser. No. 07/296,961 (which is equivalent to EPO Publication No. 0 378 504, which published Jul. 18, 1990), filed in the names of Terry Dennis Claar et al., on Jan. 13, 1989, and entitled "A Process for Preparing Self-Supporting Bodies Having Controlled Porosity and Graded Properties and Products Produced Thereby", discloses reacting a mixture of powdered parent metal with a bed or mass comprising boron carbide and, optionally, one or more inert fillers. Additionally, it is disclosed that both a powdered parent metal and a body or pool of molten parent metal can be induced to react with a bed or mass comprising boron carbide. The body which is produced is a body which has controlled or graded properties.

The disclosures of each of the above-discussed Commonly Owned U.S. Patent Applications and Patents are herein expressly incorporated by reference.

SUMMARY OF THE INVENTION

In accordance with a first step of the present invention, somewhat porous self-supporting ceramic bodies are produced by utilizing a parent metal infiltration and reaction process (i.e. reactive infiltration) in the presence of a bed or mass comprising a boron donor material and a carbon donor material and/or a boron donor material and a nitrogen donor material, such as, for example, boron carbide or boron nitride. Such bed or mass is infiltrated by molten parent metal, and the bed may be comprised entirely of boron carbide, boron nitride, and/or mixtures of boron donor materials and carbon donor materials and/or boron donor materials and nitrogen donor materials. Depending on the particular reactants involved in the reactive infiltration, the resulting bodies which are produced comprise one or more reaction products such as one or more parent metal boron-containing compounds, and/or one or more parent metal carbon-containing compounds and/or one or more parent metal nitrogen-containing compounds, etc. Alternatively, the mass to be infiltrated may contain one or more inert fillers admixed therewith to produce a composite by reactive infiltration, which composite comprises a matrix of one or more of the aforementioned reaction products and also may include residual unreacted or unoxidized constituents of the parent metal. The filler material may be embedded by the formed matrix. The final product may include a metallic component which may comprise as one or more metallic constituents of the parent metal. Still further, in some cases it may be desirable to add a carbon donor material (i.e., a carbon-containing compound) and/or a boron donor material (i.e., a boron-containing compound), and/or a nitrogen donor material (i.e., a nitrogen-containing compound) to the bed or mass which is to be infiltrated to modify, for example, the relative amounts of one formed reaction product to another, thereby modifying resultant mechanical properties of the composite body. Still further, the reactant concentrations and process conditions may be altered or controlled to yield a body containing varying volume percents of ceramic compounds, metal and/or porosity.

The self-supporting body which is produced in accordance with the first step of the invention needs to be relatively porous so that the formed porosity can be later filled by metal. It is desirable for at least some of the porosity to be at least partially interconnected, and in one preferred embodiment, it is desirable for substantially all of the porosity to be interconnected. The porosity can be formed by a number of different techniques, including: not permitting complete reaction of the reactants to occur; providing insufficient amounts of at least one reactant; incorporating at least one material which will cause porosity to be formed; utilizing a combination of parent metal and mass to be reactively infiltrated which does not substantially completely react; incorporating a powdered parent metal in the mass to be reactively infiltrated; etc.

Broadly, in accordance with the first step of the method according to this invention, the bed or mass which is to be reactively infiltrated may be placed adjacent to or in contact with a body of molten parent metal or parent metal alloy, which is melted in a substantially inert environment within a particular temperature envelope. Appropriate parent metals for use in the present invention include such metals as zirconium, titanium, hafnium, aluminum, vanadium, chromium, niobium, etc., and particularly preferred parent metals include zirconium, titanium and hafnium. The molten metal infiltrates the mass and reacts with at least one constituent of the bed or mass to be infiltrated to form one or more reaction products. At least a portion of the formed reaction product is maintained in contact with the metal, and molten metal is drawn or transported toward the remaining unreacted mass by a wicking or capillary action. This transported metal forms additional reaction product upon contact with the remaining unreacted mass, and the formation or development of a ceramic body is continued until the parent metal or remaining unreacted mass has been consumed, or until the reaction temperature is altered to be outside the reaction temperature envelope. The resulting structure comprises, depending upon the particular materials comprising the bed or mass which is to be reactively infiltrated, one or more of a parent metal boride, a parent metal boro compound, a parent metal carbide, a parent metal nitride, a metal (which as used herein is intended to include alloys and intermetallics), or voids, or a combination thereof, and these several phases may or may not be interconnected in one or more dimensions. The final volume fractions of the reaction products and metallic phases, and the degree of interconnectivity, can be controlled by changing one or more conditions, such as the initial density of the mass to be reactively infiltrated, the relative amounts and chemical composition of the materials contained within the mass which is to be reactively infiltrated, the amount of parent metal provided for reaction, the composition of the parent metal, the presence and amount of one or more filler materials, temperature, time, etc.

Typically, the mass to be reactively infiltrated should be at least somewhat porous so as to allow for wicking the parent metal through the reaction product. Wicking occurs apparently either because any volume change on reaction does not fully close off pores through which parent metal can continue to wick, or because the reaction product remains permeable to the molten metal due to such factors as surface energy considerations which render at least some of its grain boundaries permeable to the parent metal.

In another aspect of the first step of the invention, a composite is produced by the transport of molten parent metal into the bed or mass which is to be reactively infiltrated which has admixed therewith one or more inert filler materials. In this embodiment, one or more suitable filler materials are mixed with the bed or mass to be reactively infiltrated. The resulting self-supporting ceramic-metal composite that is produced typically comprises a dense microstructure which comprises a filler embedded by a matrix comprising at least one parent metal reaction product, and also may include a substantial quantity of metal. Typically, only a small amount of material (e.g., a small amount of boron carbide, etc.) is required to promote the reactive infiltration process. Thus, the resulting matrix can vary in content from one composed primarily of metallic constituents thereby exhibiting certain properties characteristic of the parent metal, to cases where a high concentration of reaction product is formed, which dominates the properties of the matrix. The filler may serve to enhance the properties of the composite, lower the raw materials cost of the composite, or moderate the kinetics of the reaction product formation reactions and the associated rate of heat evolution. The precise starting amounts and composition of materials utilized in the reactive infiltration process can be selected so as to result in a desirable body which is compatible with the second step of the invention.

In another aspect of the first step of the present invention, the material to be reactively infiltrated is shaped into a preform corresponding to the geometry of the desired final composite. Reactive infiltration of the preform by the molten parent metal results in a composite having the net shape or near net shape of the preform, thereby minimizing expensive final machining and finishing operations. Moreover, to assist in reducing the amount of final machining and finishing operations, a barrier material can at least partially, or substantially completely, surround the preform. For example, a graphite material (e.g., a graphite mold, a graphite tape product, a graphite coating, etc.) is particularly useful as a barrier for such parent metals as zirconium, titanium, or hafnium, when used in combination with preforms made of, for example, boron carbide, boron nitride, boron and carbon. Still further, by placing an appropriate number of through-holes having a particular size and shape in the aforementioned graphite mold, the amount of porosity which typically occurs within a composite body manufactured according to the first step of the present invention, can be reduced. Typically, a plurality of holes is placed in a bottom portion of the mold, or that portion of the mold toward which reactive infiltration occurs. The holes function as a venting means which permit the removal of, for example, argon gas which has been trapped in the preform as the parent metal reactive infiltration front infiltrates the preform.

Still further, the procedures discussed above herein in the Section "Discussion of Commonly Owned U.S. Patents and Patent Applications" may be applicable in connection with the first step of the present invention.

Once a self-supporting body has been formed in accordance with the first step of the present invention, then the second step of the present invention is put into effect. Specifically, the second step of the present invention involves infiltrating the porosity which was formed in a self-supporting body made in accordance with the first step of the invention with a metal having a composition which is substantially similar to, or substantially different from, the parent metal utilized to form reaction product in the first step of the invention.

A primary selection criteria for selecting the metal which is to fill at least a portion of the porosity formed in the body in accordance with the first step of the present invention, is that the metal should be capable of desirably infiltrating the porosity without the requirement for the application of external pressure. However, in some cases, it may be desirable to assist (e.g., by application of pressure) a certain metal(s) to infiltrate the formed porosity due to particular desirable characteristics which may be achieved by using that specific metal. Moreover, compatibility of the metal with the remaining constituents in the formed body is also important. Thus, selection of the metal should be governed by the ability to insert a particular metal into the porosity of a formed body, as well as the desired properties of the ultimately formed body. Typically, these factors need to be balanced by an artisan of ordinary skill to achieve the precise desirable composition of metal, as well as an acceptable technique for placing the metal in the porosity of a first formed self-supporting body. Suitable metals which may be utilized to infiltrate the porosity of a porous self-supporting body may include, for example, zirconium, titanium, hafnium, aluminum, vanadium, niobium, tantalum, chromium, manganese, iron, cobalt, nickel, copper, zinc, etc., and alloys and combinations thereof.

In a preferred embodiment of the invention, the metal, when made molten, is placed into the porosity of the first formed body. Specifically, by contacting a molten metal with the porosity in a formed self-supporting body, the molten metal can be caused to wick into such porosity by a wetting phenomenon. Such wicking action is desirable because the application of external pressure is not required to assist in the infiltration process.

DEFINITIONS

As used in this specification and the appended claims, the terms below are defined as follows:

"Parent metal" refers to that metal, e.g. zirconium, titanium, hafnium, etc., which is the precursor to the polycrystalline oxidation reaction product, that is, the parent metal boride, parent metal carbide, parent metal nitride, or other parent metal compound, and includes that metal as a pure or relatively pure metal, a commercially available metal having impurities and/or alloying constituents therein, and an alloy in which that metal precursor is the major constituent; and when a specific metal is mentioned as the parent metal, e.g. zirconium, titanium, hafnium, etc., the metal identified should be read with this definition in mind unless indicated otherwise by the context.

"Parent metal boride" and "parent metal boro compounds" mean a reaction product containing boron formed upon reaction between a boron donor material, such as boron carbide or boron nitride, and the parent metal and includes a binary compound of boron with the parent metal as well as ternary or higher order compounds.

"Parent metal nitride" means a reaction product containing nitrogen formed upon reaction of a nitrogen donor material, such as boron nitride, and the parent metal.

"Parent metal carbide" means a reaction product containing carbon formed upon reaction of a carbon donor material, such as boron carbide, and the parent metal.

DETAILED DESCRIPTION OF THE INVENTION AND PREFERRED EMBODIMENTS

Figure 1:
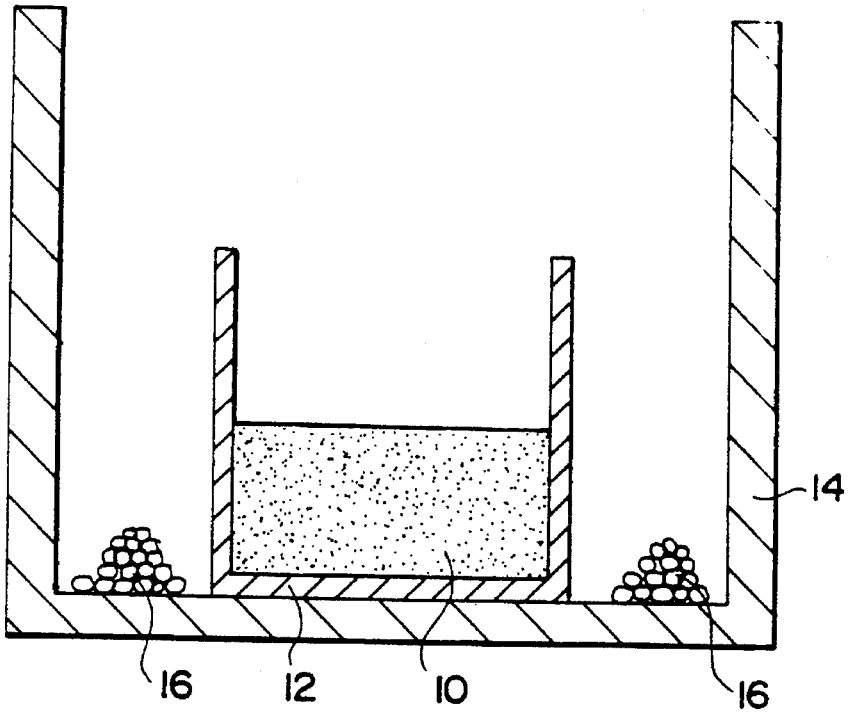
FIG. 1 is a schematic view of the lay-up used to fabricate a platelet reinforced composite body.

In accordance with a first step of the present invention, somewhat porous self-supporting ceramic bodies are produced by utilizing a parent metal infiltration and reaction process (i.e. reactive infiltration) in the presence of a bed or mass comprising a boron donor and a carbon donor and/or a boron donor and a nitrogen donor, such as, for example, boron carbide or boron nitride. Such bed or mass is infiltrated by molten parent metal, and the bed may be comprised entirely of boron carbide, boron nitride, and/or mixtures of boron donor materials and carbon donor materials and/or boron donor materials and nitrogen donor materials. Depending on the particular reactants involved in the reactive infiltration, the resulting bodies which are produced comprise one or more reaction products such as one or more parent metal boron-containing compounds, and/or one or more parent metal carbon-containing compounds and/or one or more parent metal nitrogen-containing compounds, etc. Alternatively, the mass to be infiltrated may contain one or more inert fillers admixed therewith to produce a composite by reactive infiltration, which composite comprises a matrix of one or more of the aforementioned reaction products and also may include residual unreacted or unoxidized constituents of the parent metal. The filler material may be embedded by the formed matrix. The final product may include a metallic component which may comprise one or more metallic constituents of the parent metal. Still further, in some cases it may be desirable to add a carbon donor material (i.e., a carbon-containing compound) and/or a boron donor material (i.e., a boron-containing compound) and/or a nitrogen donor material (i.e., a nitrogen-containing compound) to the bed or mass which is to be infiltrated to modify, for example, the relative amounts of one formed reaction product to another, thereby modifying resultant mechanical properties of the composite body. Still further, the reactant concentrations and process conditions may be altered or controlled to yield a body containing varying volume percents of ceramic compounds, metal and/or porosity.

The self-supporting body which is produced in accordance with the first step of the invention needs to be relatively porous so that the formed porosity can be later filled by metal. It is desirable for at least some of the porosity to be at least partially interconnected, and in one preferred embodiment, it is desirable for substantially all of the porosity to be interconnected. The porosity can be formed by a number of different techniques, including: not permitting complete reaction of the reactants to occur; providing insufficient amounts of at least one reactant; incorporating at least one material which will cause porosity to be formed; utilizing a combination of parent metal and mass to be reactively infiltrated which does not substantially completely react; incorporating a powdered parent metal in the mass to be reactively infiltrated; etc.

Broadly, in accordance with the first step of the method according to this invention, the bed or mass which is to be reactively infiltrated may be placed adjacent to or contacted with a body of molten metal or metal alloy, which is melted in a substantially inert environment within a particular temperature envelope. Appropriate parent metals for use in the present invention include such metals as zirconium, titanium, hafnium, aluminum, vanadium, chromium, niobium, etc., and particularly preferred metals include zirconium, titanium and hafnium. The molten metal infiltrates the mass and reacts with at least one constituent of the bed or mass to be infiltrated to form one or more reaction products. At least a portion of the formed reaction product is maintained in contact with the metal, and molten metal is drawn or transported toward the remaining unreacted mass by a wicking or capillary action. This transported metal forms additional reaction product upon contact with the remaining unreacted mass, and the formation or development of a ceramic body is continued until the parent metal or remaining unreacted mass has been consumed, or until the reaction temperature is altered to be outside the reaction temperature envelope. The resulting structure comprises, depending upon the particular materials comprising the bed or mass which is to be reactively infiltrated, one or more of a parent metal boride, a parent metal boro compound, a parent metal carbide, a parent metal nitride, a metal (which as used herein is intended to include alloys and intermetallics), or voids, or a combination thereof, and these several phases may or may not be interconnected in one or more dimensions. The final volume fractions of the reaction products and metallic phases, and the degree of interconnectivity, can be controlled by changing one or more conditions, such as the initial density of the mass to be reactively infiltrated, the relative amounts and chemical composition of the materials contained within the mass which is to be reactively infiltrated, the amount of parent metal provided for reaction, the composition of the parent metal, the presence and amount of one or more filler materials, temperature, time, etc.

Typically, the mass to be reactively infiltrated should be at least somewhat porous so as to allow for wicking the parent metal through the reaction product. Wicking occurs apparently either because any volume change on reaction does not fully close off pores through which parent metal can continue to wick, or because the reaction product remains permeable to the molten metal due to such factors as surface energy considerations which render at least some of its grain boundaries permeable to the parent metal.

In another aspect of the first step of the invention, a composite is produced by the transport of molten parent metal into the bed or mass which is to be reactively infiltrated which has admixed therewith one or more inert filler materials. In this embodiment, one or more suitable filler materials are mixed with the bed or mass to be reactively infiltrated. The resulting self-supporting ceramic-metal composite that is produced typically comprises a dense microstructure which comprises a filler embedded by a matrix comprising at least one parent metal reaction product, and also may include a substantial quantity of metal. Typically, only a small amount of material (e.g., a small amount of boron carbide, etc.) is required to promote the reactive infiltration process. Thus, the resulting matrix can vary in content from one composed primarily of metallic constituents thereby exhibiting certain properties characteristic of the parent metal; to cases where a high concentration of reaction product is formed, which dominates the properties of the matrix. The filler may serve to enhance the properties of the composite, lower the raw materials cost of the composite, or moderate the kinetics of the reaction product formation reactions and the associated rate of heat evolution. The precise starting amounts and composition of materials utilized in the reactive infiltration process can be selected so as to result in a desirable body which is compatible with the second step of the invention.

In another aspect of the first step of the present invention, the material to be reactively infiltrated is shaped into a preform corresponding to the geometry of the desired final composite. Subsequent reactive infiltration of the preform by the molten parent metal results in a composite having the net shape or near net shape of the preform, thereby minimizing expensive final machining and finishing operations. Moreover, to assist in reducing the amount of final machining and finishing operations, a barrier material can at least partially, or substantially completely, surround the preform. For example, a graphite material (e.g., a graphite mold, a graphite tape product, a graphite coating, etc.) is particularly useful as a barrier for such parent metals as zirconium, titanium, or hafnium, when used in combination with preforms made of, for example, boron carbide, boron nitride, boron and carbon. Still further, by placing an appropriate number of through-holes having a particular size and shape in the aforementioned graphite mold, the amount of porosity which typically occurs within a composite body manufactured according to the first step of the present invention, can be reduced. Tpyically, a plurality of holes is placed in a bottom portion of the mold, or that portion of the mold toward which reactive infiltration occurs. The holes function as a venting means which permit the removal of, for example, argon gas which has been trapped in the preform as the parent metal reactive infiltration front infiltrates the preform.

Still further, the procedures discussed above herein in the Section "Discussion of Commonly Owned U.S. Patents and Patent Applications" may be applicable in connection with the first step of the present invention.

Once a self-supporting body has been formed in accordance with the first step of the present invention, then the second step of the present invention is put into effect. Specifically, the second step of the present invention involves infiltrating the porosity which was formed in a self-supporting body made in accordance with the first step of the invention with a metal having a composition which is substantially similar to, or substantially different from, the parent metal utilized to form reaction product in the first step of the invention.

A primary selection criteria for selecting the metal which is to fill at least a portion of the porosity formed in the body in accordance with the first step of the present invention, is that the metal should be capable of desirably infiltrating the porosity without the requirement for the application of external pressure. However, in some cases, it may be desirable to assist (e.g., by application of pressure) a certain metal(s) to infiltrate the formed porosity due to particular desirable characteristics which may be achieved by using that specific metal. Moreover, compatibility of the metal with the remaining constituents in the formed body is also important. Thus, selection of the metal should be governed by the ability to insert a particular metal into the porosity of a formed body, as well as the desired properties of the ultimately formed body. Typically, these factors need to be balanced by an artisan of ordinary skill to achieve the precise desirable composition of metal, as well as an acceptable technique for placing the metal in the porosity of a first formed self-supporting body. Suitable metals which may be utilized to infiltrate the porosity of a porous self-supporting body may include, for example, zirconium, titanium, hafnium, aluminum, vanadium, niobium, tantalum, chromium, manganese, iron, cobalt, nickel, copper, zinc, etc., and alloys and combinations thereof.

In a preferred embodiment of the invention, the metal, when made molten, is placed into the porosity of the first formed body. Specifically, by contacting a molten metal with the porosity in a formed self-supporting body, the molten metal can be caused to wick into such porosity by a wetting phenomenon. Such wicking action is desirable because the application of external pressure is not required to assist in the infiltration process.

The following are examples of the present invention. The Examples are intended to be illustrative of various aspects of the present invention, however, these examples should not be construed as limiting the scope of the invention.

EXAMPLE 1

This Example demonstrates a method for reducing the amount of porosity in a porous platelet reinforced composite body by reinfiltrating said body with additional parent metal. The lay-up used to produce the platelet reinforced composite body is shown in FIG. 1, while the lay-up used to reinfiltrate said body with additional parent metal is shown in FIG. 2.

About 53.43 grams of 100 grit TETRABOR® boron carbide particulate (Engineered Ceramics, New Canaan, Conn.), having an average particle size of about 173 microns, about 3.39 grams of ACRAWAX® C wax binder (Lonza, Inc., Fair Lawn, N.J.), and about 172.41 grams of titanium particulate (−100 mesh, Consolidated Astronautics, Saddle River, N.J.), having substantially all particles smaller than about 150 microns, were placed into an approximately one liter NALGENE® plastic jar (Nalge Company, Rochester, N.Y.) and roll mixed on a mill rack for about 1 ½ hours to form an admixture.

A dry pressing die made of tool steel was set up on a vibration table and vibration was commenced. The roll mixed powder admixture was slowly poured into the die. The degree of vibration was adjusted such that particle movement could just barely be detected under the action of the vibration. After substantially all of the roll mixed powder admixture had been introduced into the die cavity and vibrated, the top pressing punch was inserted and the pressing die was placed into a hand operated hydraulic press. The roll mixed powder admixture was pressed under an applied pressure of about 10,000 psi (69 MHPa) to make a preform. The dry pressed powder preform 10 which was removed from the die measured about 2.0 inches (51 mm) square by about 1.0 inch (25 mm) thick.

Figure 2:
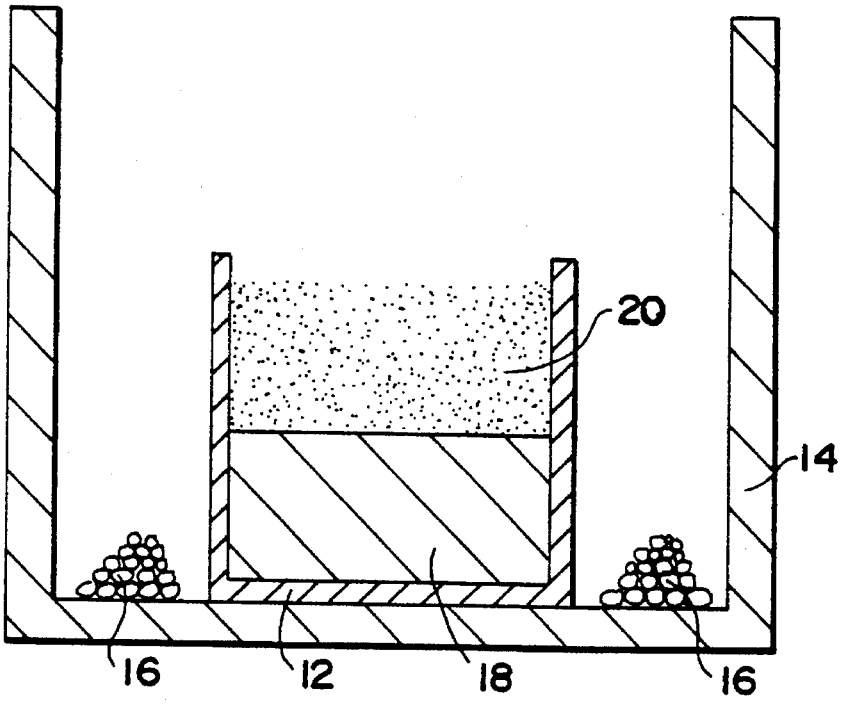
FIG. 2 is a schematic view of the lay-up used to reinfiltrate the formed platelet reinforced composite body with additional metal.

As shown in FIG. 1, the dry pressed preform 10 was then placed into a Grade ATJ graphite crucible 12 (Union Carbide Company, Carbon Products Division, Cleveland, Ohio), having interior dimensions measuring about 2.0 inches (51 mm) square by about 3.0 inches (76 mm) high. The graphite crucible 12 containing the dry pressed preform 10 was then placed into a vacuum furnace. The furnace chamber was evacuated to about 30 inches (762 mm) of mercury vacuum and backfilled with argon gas. After repeating this procedure, an argon gas flow rate of about two liters per minute was established through the furnace chamber at an overpressure of about 1 psi (7 kPa). The furnace temperature was then increased from about room temperature to a temperature about 200° C. at a rate of about 50° C. per hour. Upon reaching a temperature of about 200° C., the temperature was then increased to about 570° C. at a rate of about 30° C. per hour. After maintaining a temperature of about 570° C. for about one hour, substantially all of the wax binder had volatilized. Accordingly, the temperature was then decreased to about room temperature at a rate of about 100° C. per hour. After cooling down to about room temperature, the graphite crucible 12 and its contents were removed from the furnace.

The graphite crucible 12 and the dry pressed preform 10 was then placed into a graphite boat 14 measuring about 6.0 inches (150 mm) square and about 4.0 inches (102 mm) high. About 200 grams of nuclear grade zirconium sponge 16 (Western Zirconium, Ogden, Utah) was placed in the graphite boat 14 around the graphite crucibles 12 to serve as a gettering agent for oxygen and nitrogen impurities. The graphite boat 14 and its contents were then placed into a vacuum furnace. The furnace chamber was evacuated using a mechanical roughing pump to about 30 inches (762 mm) of mercury vacuum and backfilled with argon gas. The chamber was evacuated a second time with the roughing pump, but this time followed by a high vacuum source to produce a working operating pressure of less than $10^{-4}$ torr. The furnace temperature was then increased from about room temperature to a temperature of about 250° C. at a rate of about 100° C. per hour. Upon reaching a temperature of about 250° C, the temperature was then increased to about 1800° C. at a rate of about 400° C. per hour. Upon reaching an intermediate temperature of about 1000° C., the high vacuum source was disconnected from the furnace chamber and heating continued throughout the rest of the run utilizing the mechanical roughing pump as the vacuum source. After maintaining a temperature of about 1800° C. for about two hours, the furnace chamber was cooled to about room temperature at a rate of about 350° C. per hour. The graphite boat 14 and its contents were removed from the furnace. The formed platelet reinforced composite, weighing about 164 grams, and measuring about 2.0 inches (51 mm) square by about 1.0 inch (25 mm) thick, was removed from the graphite crucible 12. The calculated bulk density of the composite was about 2.52 grams per cubic centimeter, corresponding to a theoretical density of about 66.5%.

As shown in FIG. 2, the platelet reinforced composite body 18 with approximately 33.5% porosity was then placed back into the graphite crucible 12. About 142 grams of titanium particulate 20 (−80 +325 mesh, Consolidated Astronautics, Saddle River, N.J.), having substantially all particles between about 45 microns and about 177 microns in diameter, was placed into the graphite crucible 12 on top of the porous body of platelet reinforced composite material 18 and levelled to form a lay-up. The lay-up was placed into a graphite boat 14 measuring about 6 inches (52 mm), by about 6 inches (52 mm), by about 4 inches (102 mm) high. About 200 grams of nuclear grade zirconium sponge 16 (Western Zirconium, Ogden, Utah) was placed in the graphite boat 14 around the graphite crucible 12 to getter any gaseous impurities.

The graphite boat 14 and its contents were placed into a vacuum furnace. The furnace chamber was evacuated to about 30 inches (762 mm) of mercury vacuum and then backfilled with argon gas. A second evacuation was performed to about 30 inches (762 mm) of mercury vacuum, at which point a high vacuum source was connected to the furnace chamber to pump the chamber down to a final working pressure of about $4\times10^{-4}$ torr. The furnace temperature was then increased from about room temperature to a final temperature of about 1900° C. at a rate of about 400° C. per hour. At an intermediate temperature of about 1000° C., however, the high vacuum source was isolated from the furnace chamber and for the remainder of the run the chamber was pumped with the mechanical roughing pump. After maintaining a temperature of about 1900° C. for about two hours, the furnace temperature was then decreased to substantially room temperature at a rate of about 350° C. per hour. Upon cooling to about room temperature, the graphite boat and its contents were removed from the furnace chamber. The body which was recovered from the graphite crucible was found to weigh about 302 grams and measured about 2.04 inches (52 mm) square by about 1.14 inches (29 mm) high. The bulk density was calculated to be about 3.86 grams per cubic centimeter, which corresponds to a theoretical density of about 86.0%. The reinfiltration of the porous platelet reinforced composite body 18 with additional molten parent metal 20 increased the density of the body and concomitantly reduced the volume fraction of porosity from about 33.5% to about 14.2%.

I claim:

1. A method for producing a self-supporting body, comprising:

providing at least one porous self-supporting body which is made by a process comprising: (i) forming an admixture comprising a powdered parent metal and a mass comprising at least one boron donor material, wherein an amount of said mass comprising at least one boron donor material of said admixture is insufficient to react completely with all of said parent metal; (ii) heating said parent metal in a substantially inert atmosphere to a temperature above its melting point to form molten parent metal contacting said mass comprising at least one boron material; (iii) maintaining said temperature for a time sufficient to permit reaction of said molten parent metal with said mass comprising at least one boron donor material to form at least one boron-containing compound; (iv) continuing said reaction for a time sufficient to produce said at least one porous self-supporting body;

contacting at least a portion of said at least one porous self-supporting body with at least one body of molten metal having a composition which is substantially similar to said parent metal;

infiltrating at least a portion of the porosity of said at least one porous self-supporting body with molten metal; and continuing said infiltration for a time sufficient to infiltrate a desired amount of porosity, thereby forming a self-supporting body which is more dense than said at least one porous self-supporting body.

2. The method of claim 1, wherein said parent metal comprises at least one metal selected from the group consisting of titanium, zirconium, hafnium, aluminum, vanadium, chromium and niobium, and alloys thereof.

3. The method of claim 2, wherein said parent metal comprises at least one metal selected from the group consisting of zirconium, titanium and hafnium.

4. The method of claim 1, wherein said at least one porous self-supporting body comprises at least two materials selected from the group consisting of at least one boron-containing material, at least one carbon-containing material, at least one nitrogen-containing material and metal.

5. The method of claim 1, wherein said mass further comprises at least one material selected from the group consisting of a carbon donor material and a nitrogen donor material.

6. The method of claim 5, wherein said mass further comprises an inert filler material.

7. The method of claim 5, wherein said mass comprises at least one material selected from the group consisting of boron, carbon, boron carbide and boron nitride.

8. The method of claim 1, further comprising incorporating a porosity forming material in said mass.

9. The method of claim 1, wherein at least a portion of said mass remains unreacted in said at least one produced porous self-supporting body.

10. The method of claim 1, wherein said porous body comprises at least two materials selected from the group consisting of a parent metal boride, a parent metal boro compound, a parent metal carbide, a parent metal nitride, residual metal and voids.

11. The method of claim 1, wherein said admixture comprises a preform.

12. The method of claim 1, further comprising providing a barrier in contact with at least one surface of said admixture.

13. The method of claim 12, wherein said barrier comprises a graphite material in the form of a graphite mold, a graphite tape or a graphite coating.

14. The method of claim 1, wherein said molten metal infiltrates said at least one porous self-supporting body without the requirement for the application of pressure.

15. The method of claim 1, wherein said molten metal comprises at least one metal selected from the group consisting of zirconium, titanium, hafnium, aluminum, vanadium, niobium, tantalum, chromium, manganese, iron, cobalt, nickel, copper, zinc, and alloys and combinations thereof.

16. The method of claim 1, wherein said parent metal comprises a metal selected from the group consisting of zirconium, titanium and hafnium, and said mass comprises a material selected from the group consisting of boron carbide and boron nitride.

17. The method of claim 1, wherein said parent metal comprises zirconium, said filler comprises boron carbide and said molten metal comprises titanium.

18. The method of claim 1, further comprising reactively infiltrating said admixture from an external body of parent metal contacting said admixture.

* * * * *